US007614762B2

(12) United States Patent
Tseng

(10) Patent No.: US 7,614,762 B2
(45) Date of Patent: Nov. 10, 2009

(54) LAMP HOLDER WITH IMPROVED STRUCTURE

(76) Inventor: Ming-chi Tseng, No. 18, Jhensing E. St., Wufong Township, Taichung County 413 (TW)

( * ) Notice: Subject to any disclaimer, the term of this patent is extended or adjusted under 35 U.S.C. 154(b) by 214 days.

(21) Appl. No.: 11/976,772

(22) Filed: Oct. 29, 2007

(65) Prior Publication Data

US 2009/0109693 A1 Apr. 30, 2009

(51) Int. Cl.
*F21S 8/00* (2006.01)

(52) U.S. Cl. ..... 362/150; 362/147; 362/148; 362/658; 362/362; 248/343

(58) Field of Classification Search ..... 362/150, 362/382, 147, 148, 657, 658, 640, 362, 404; 248/343

See application file for complete search history.

(56) References Cited

U.S. PATENT DOCUMENTS 4,104,713 A * 8/1978 Chan et al. ..... 362/294
6,421,904 B1 * 7/2002 Wedekind et al. ..... 29/432
6,585,389 B2 * 7/2003 Bonazzi ..... 362/147
6,790,008 B1 * 9/2004 Huang ..... 416/244 R
7,300,248 B2 * 11/2007 Wang ..... 416/5
2005/0141236 A1 * 6/2005 Lun Fong ..... 362/554

* cited by examiner

*Primary Examiner*—Sandra L O'Shea
*Assistant Examiner*—Evan Dzierzynski
(74) *Attorney, Agent, or Firm*—Rosenberg, Klein & Lee

(57) ABSTRACT

A lamp holder with improved structure includes an upper plate and a lower plate mounted to a ceiling; the upper plate has a top and a bottom with each disposed with multiple reinforcement ribs; a circular wall is disposed to the bottom; two accommodation spaces are defined by the circular wall and those reinforcement ribs on the bottom with each accommodation space disposed with a conduction reed secured in place by an elastic member; two sockets are provided to the lower plate for insertion by pins from an energy saving lamp and to constitute a conducted circuit with the conduction reed.

6 Claims, 6 Drawing Sheets

LAMP HOLDER WITH IMPROVED STRUCTURE

BACKGROUND OF THE INVENTION (a) Field of the Invention

The present invention is related to a lamp holder with an improved structure, and more particularly, to one that allows fast connection of an energy saving lamp to a ceiling.

(b) Description of the Prior Art

As illustrated in FIG. 5 of the accompanying drawings, each light bulb is usually locked with its base tightened by rotation into a lamp holder 9 of the prior art to a ceiling fitting and is electrically connected to a first conduction portion 91 and a second conduction portion 92 to constitute an electrically conducted circuit.

While the conventional light bulb is gradually replaced with an energy saving light, the energy saving light however is prevented from being mounted to the lamp holder 9 of the prior art.

Now referring to FIG. 6 showing an energy saving lamp holder 8, but it is prevented from being mounted to the ceiling.

The assembly of the energy saving lamp holder is secured with multiple locking members with each locking member comprised of a screw 5 and a nut 51. The screw 5 passes through an assembly hole 61 to combine with the nut to secure the energy saving lamp from top to bottom. Furthermore, a wire (not illustrated) penetrates through a wire socket 81 to connect to a hooking portion 71 of a conduction reed 7. When the hooking portion 71 is excessively deformed to fail effective locking with the wire, poor contact happens and even the wire will fall off.

Furthermore, pins (not illustrated) of the energy saving lamp is connected to the conduction reed only by passing through sockets 6 by taking advantage of pushing force from a coil 73 to cause pints of the energy-saving lamp and a contact 72 to connect each other to form a conducted circuit. Poor contact also happens if pins of the energy saving lamp slides away from the contact 72 to fail effective connection with the conduction reed 7. Accordingly, the structure of the lamp holder 8 warrants improvement.

SUMMARY OF THE INVENTION

The primary purpose of the present invention is to provide a lamp holder with improved structure to correct problems found with the prior art. The lamp holder of the present invention can be mounted to the ceiling while allowing safe use of the energy saving lamp.

Another purpose of the present invention is to provide a lamp holder with improved structure to improve contact between the energy saving lamp and the lamp holder to avoid poor contact.

To achieve these purposes, a lamp holder of the present invention is comprised of an upper plate including a top and a bottom; a circular wall longitudinally extends from the bottom of the upper plate; multiple first reinforcement ribs are disposed on an inner side of the circular wall; two accommodation spaces are defined by the circular wall and those first reinforcement ribs with each accommodation space being disposed with a groove, and each groove is disposed with a wire socket; the top is disposed with multiple second reinforcement ribs; and those second reinforcement ribs indicate a radiation distribution with an outer side of the circular wall as a center. The upper plate is disposed with multiple combination holes; two conduction portions with each comprised of a conduction reed and an elastic member and mounted in the accommodation space; and a lower plate provided with multiple combination grooves in quantity same as that of those multiple combination holes disposed on the upper plate for the lower plate to be locked to the upper plate, wherein the lower plate is disposed with two pin sockets for mounting the energy saving lamp.

DETAILED DESCRIPTION OF THE PREFERRED EMBODIMENTS

Figure 1:
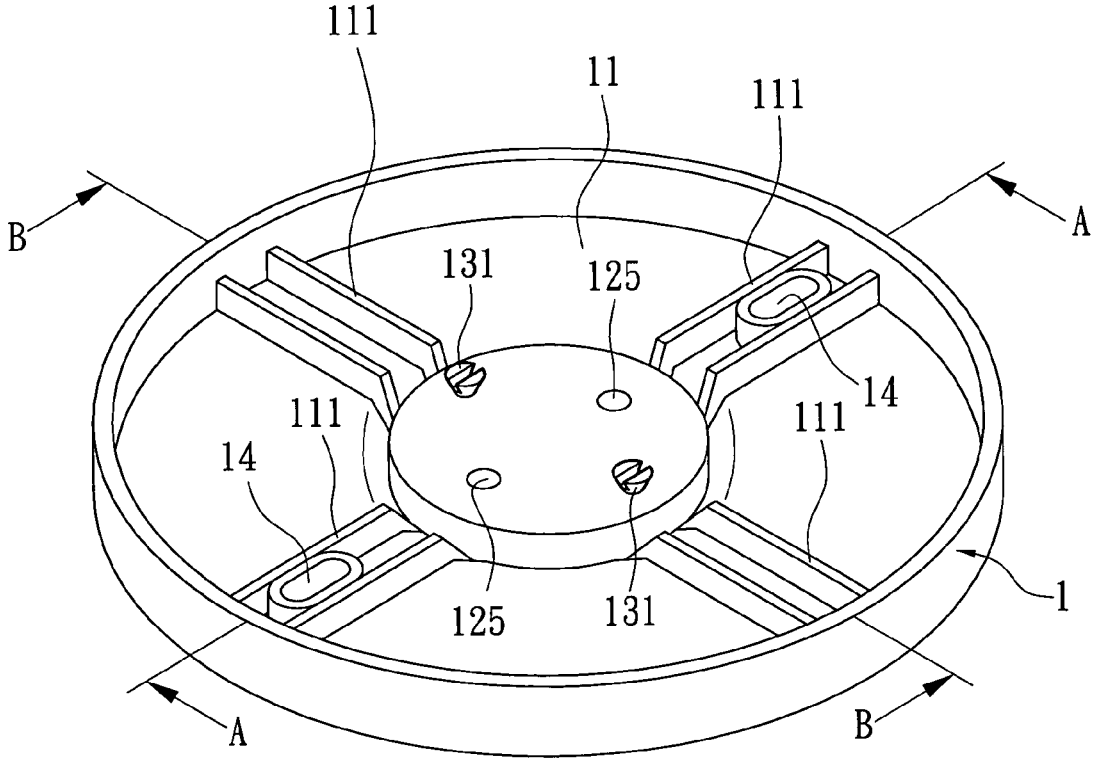
FIG. 1 is a perspective view of the present invention when viewed from its top.
Figure 2:
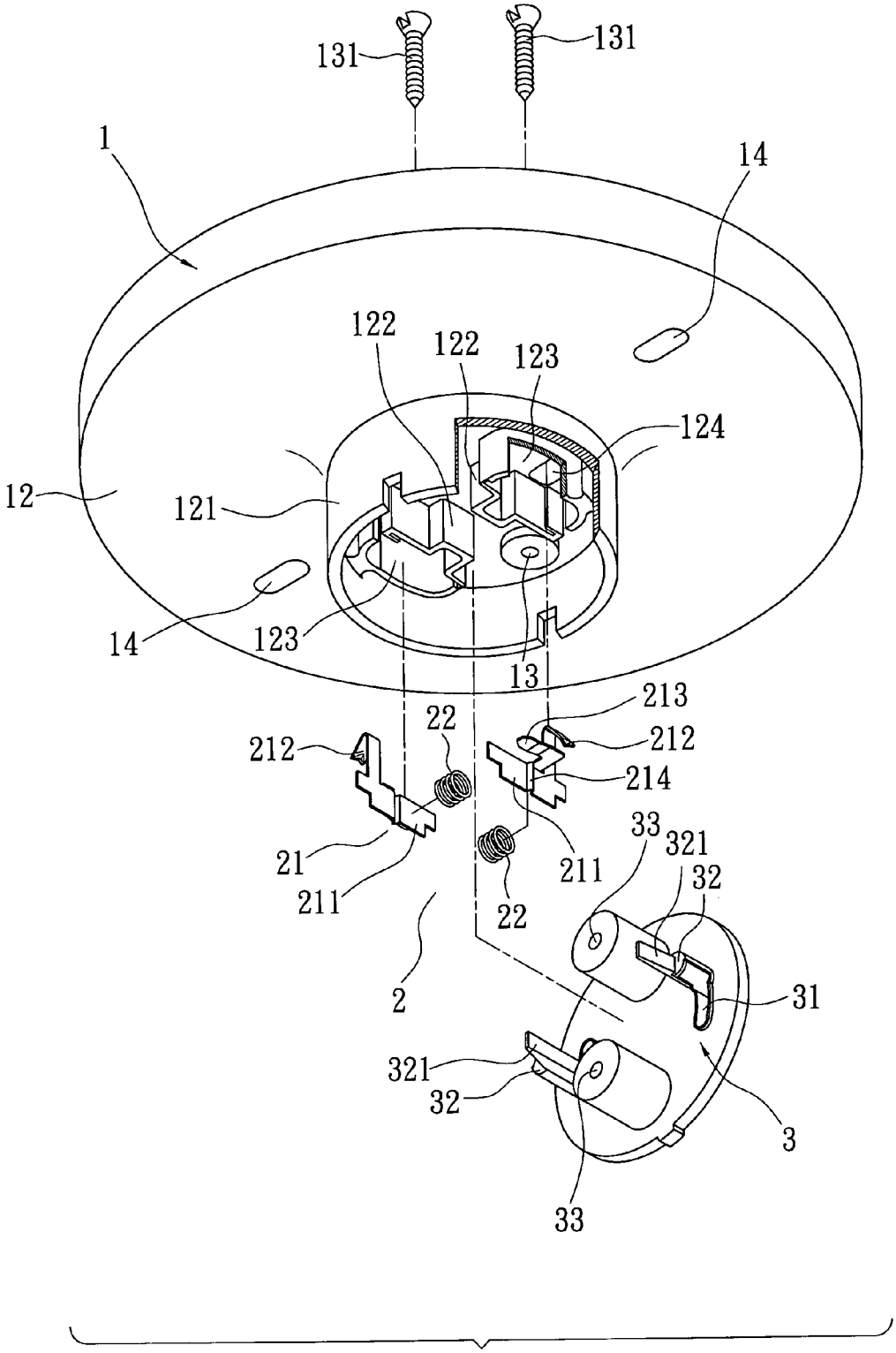
FIG. 2 is an exploded view of the present invention when viewed from under.

Referring to FIGS. 1~4 for a preferred embodiment of the preset invention, a lamp holder with improvement structure as illustrated in FIGS. 1 and 2 is comprised of an upper plate 1, two conduction portions, and a lower plate 2, and a lower plate 3.

The upper plate 1 contains a top 11 and a bottom; a circular wall 121 extends from the bottom 12; multiple first reinforcement ribs 122 are disposed on an inner side of the circular wall 121; two accommodation spaces 123 are defined by the circular wall 121 and those first reinforcement ribs 122 with each accommodation space 123 containing a groove 124; a wire socket 125 longitudinally passes through each groove 124; the top 11 is disposed with multiple second reinforcement ribs 111; and those second reinforcement ribs 111 are distributed in a radiation fashion with an outer side of the circular wall as a center.

Each conduction portion is comprised of a conduction reed 21 and an elastic member 22, or a flexible copper piece and a compression coil as provided in the preferred embodiment. The conduction reed 21 contains a locking portion 211, a hooking portion 212, and a contact portion 213. The locking portion 211 is disposed in the accommodation space 123 and the elastic member 22 pushes against the locking portion 211 to secure the locking portion therein; the hooking portion 212 is relatively disposed in the groove 124 of the accommodation space 123 to lock the wire for connecting to an external circuit; a protruding section 214 is disposed to the locking portion 211 at where it is abutted to the contact portion 213; the elastic member 22 pushes against the protruding section 214 for the protruding section 214 to lock up two pins from an energy-saving lamp with the first reinforcement rib 122 thus to prevent those pins from being easily disengaged upon connecting to the contact portion 213.

The lower plate 3 to be assembled and locked to the upper plate is disposed with two sockets 31 to receive connection of the energy saving lamp. In the preferred embodiment, the socket 31 is related to a long socket. Pins from the energy saving lamp simply are inserted into both sockets 31 and sliding in the direction of the contact portion 213 of the conduction reed 21 before being locked by the elastic member 22 and the protruding section 214. A retaining portion 32 extends from one end of the lower plate 3 at where jointed to the upper plate 1; the retaining portion 32 is disposed in relation to the groove 124 provided in the upper plate 1 for covering up the groove 124 thus to prevent the hooking portion 212 of the conduction reed 21 from failing to effectively lock up the wire due to excessive deformation. Furthermore, a post 321 longitudinally extends from one side of the retaining portion 32 so to sandwich the conduction reed 21 with those first reinforcement ribs 122 when the upper plate 1 and the lower plate 3 are jointed to each other.

Figure 3:
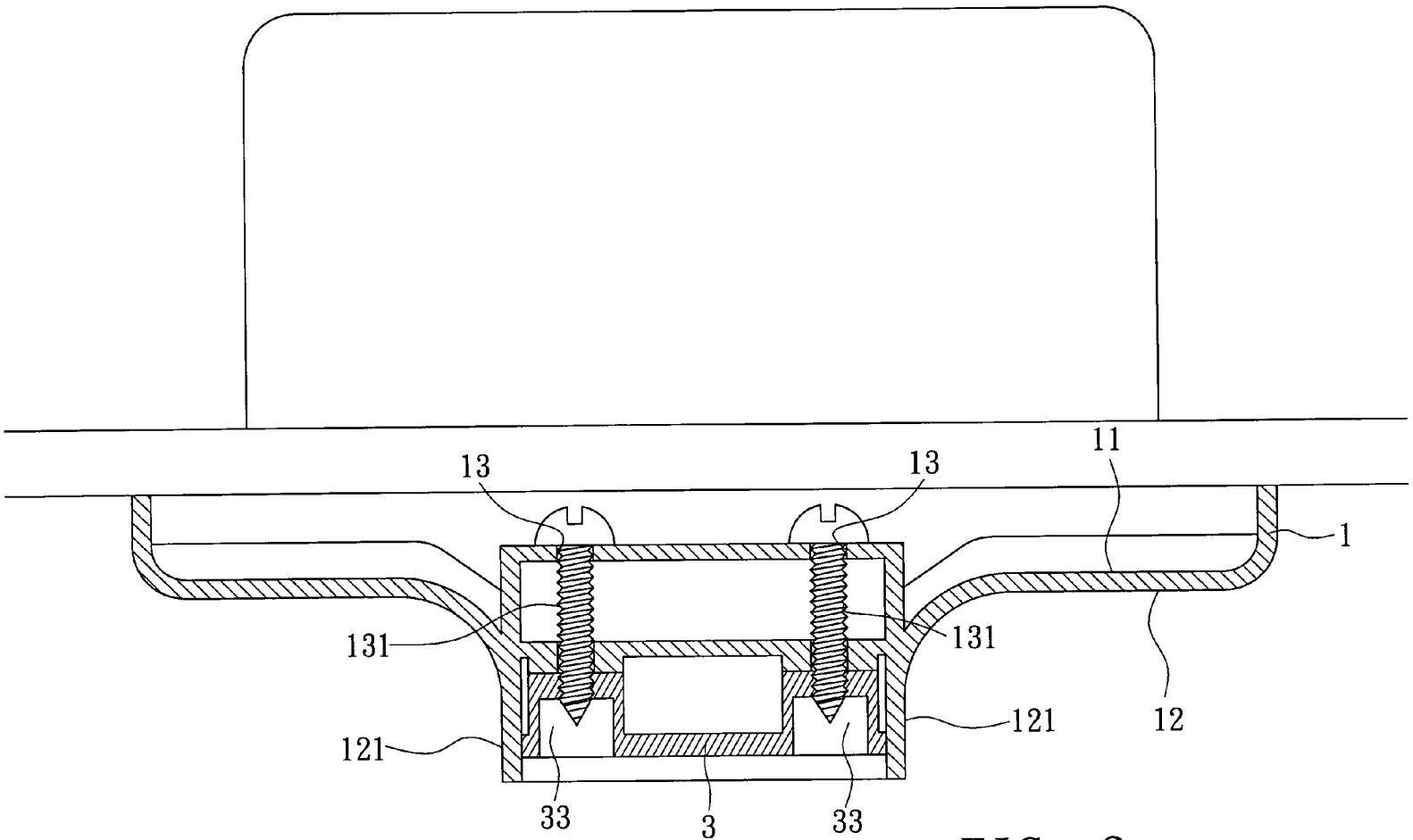
FIG. 3 is a sectional view showing an assembly of the present invention.

Upon assembling the lamp holder of the present invention, both of the upper plate 1 and the lower plate 3 are jointed to each other. As illustrated in FIG. 3 showing a sectional view of an assembly of the present invention taken from B-B in FIG. 1, multiple assembly holes 13 are disposed to the upper plate 1 multiple assembly grooves 33 in same quantity as that of the assembly holes 13 are disposed to the lower plate 3. A wooden screw 131 penetrates the assembly hole 13 and fastens the lower plate 3 from the top 11 of the upper plate 1 down to the assembly groove 33 of the lower plate 3 to complete the assembly of the lamp holder.

Figure 4:
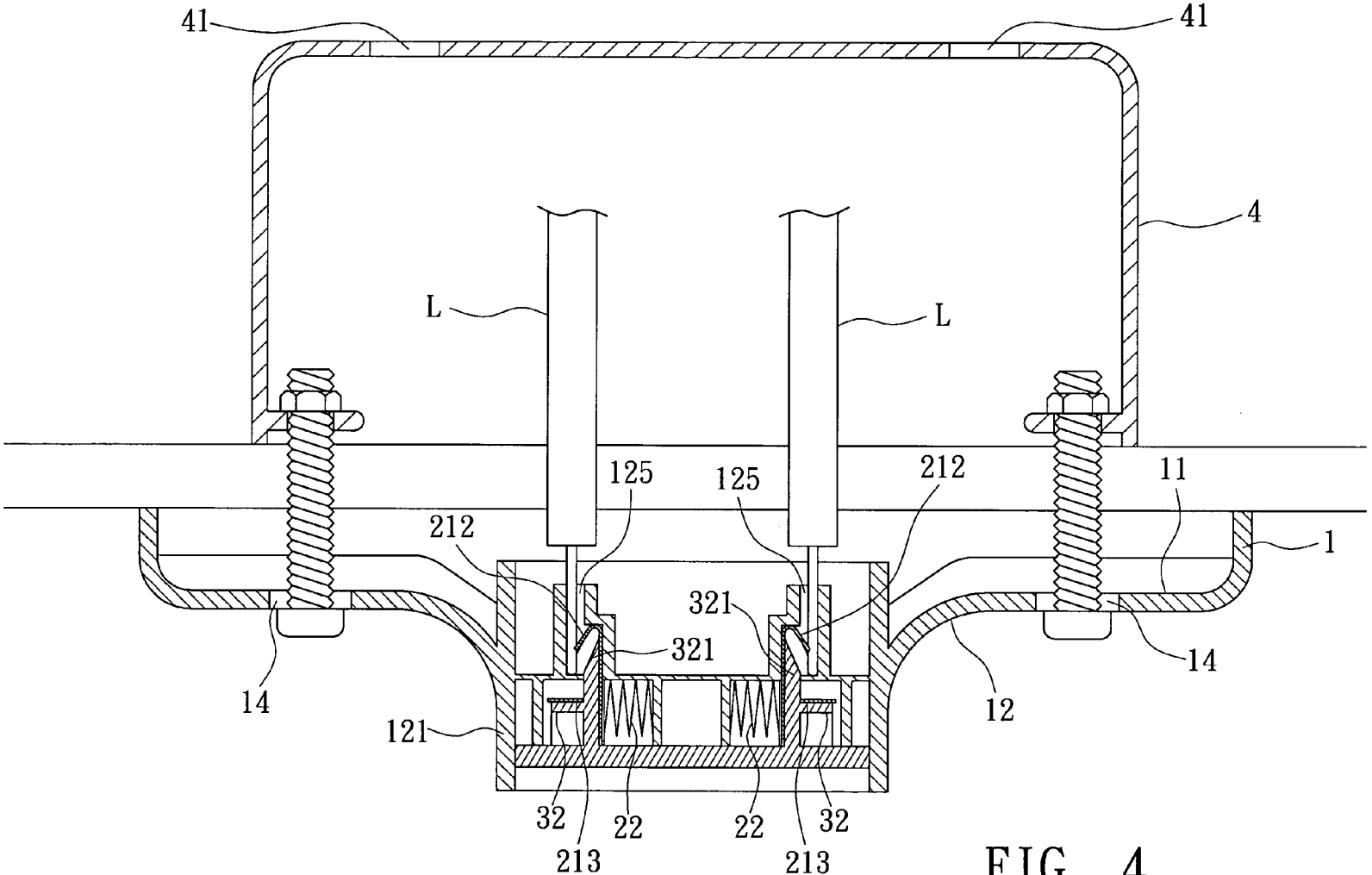
FIG. 4 is a sectional view showing an operating status of the present invention.
Figure 5:
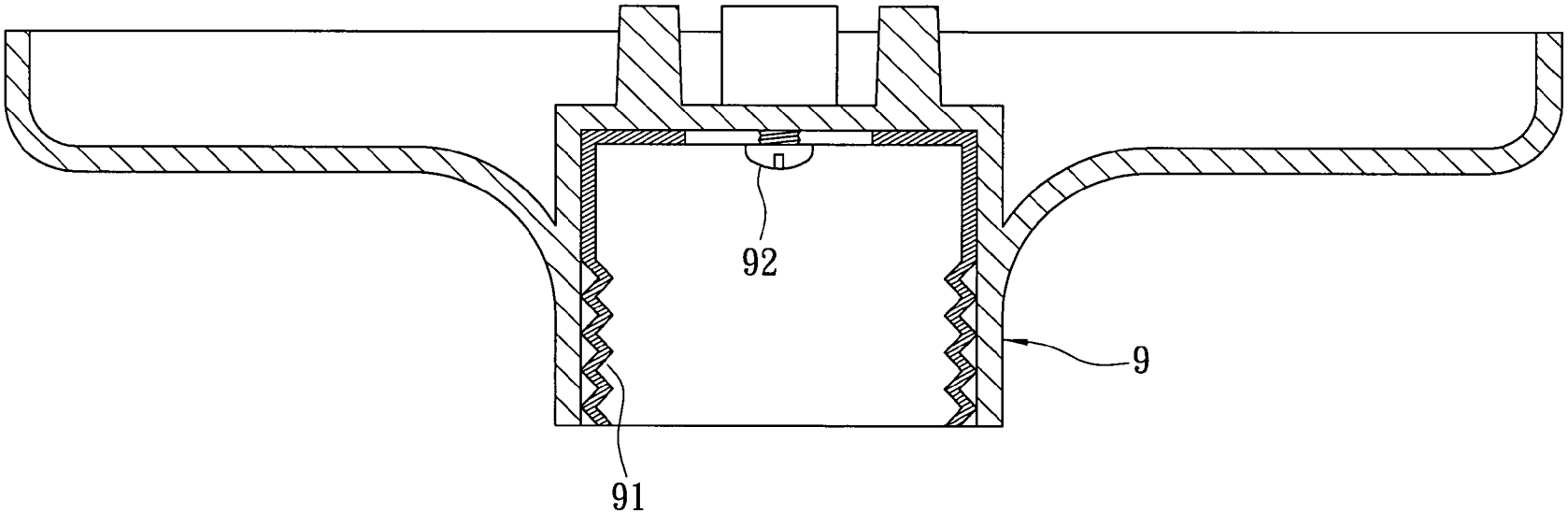
FIG. 5 PRIOR ART
FIG. 5 is a sectional view showing a lamp holder of the prior art.
Figure 6:
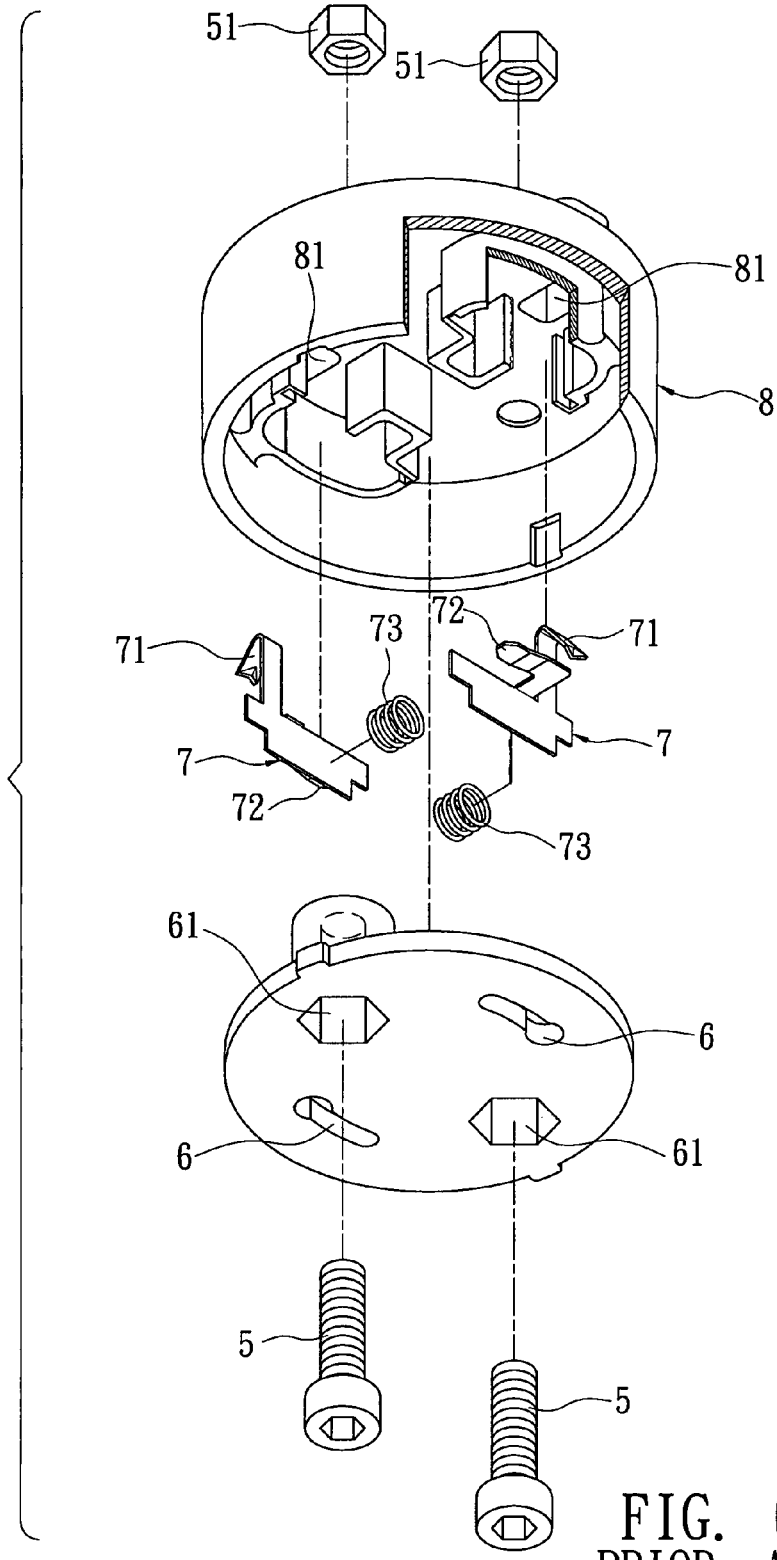
FIG. 6 PRIOR ART
FIG. 6 is a perspective view showing a structure of energy saving lamp holder of the prior art.

As illustrated in FIG. 4, a base 4 is inserted to the ceiling upon the completion of the constructional project of a building. The base 4 is disposed with one or a plurality of wire insertion hole 41 for connecting a wire L. Accordingly, multiple locking holes 14 disposed on an external peripheral of the upper plate 1 to secure the upper plate 1 to the base 4.

The present invention is capable of being secured to the ceiling to hold energy saving lamp.

If both of the upper and the lower plates are locked to each other with screws and nuts, both of the screw and the nut will get loosen up against each other and the assembly cost will be increased; instead, in the preferred embodiment, wooden screw is used to secure both plates in a direction from the top of the upper plate facing the lower plate to prevent the lower plate and the lamp from falling off due to loosening up of the screw and the nut as described earlier. Upon mounting the energy saving lamp to the lamp holder of the present invention, simply insert pins of the energy saving lamp into the sockets and slide the lamp forward, the lamp is secured in place and prevented from retreating in opposite direction.

I claim:

1. A lamp holder with improved structure comprising:

an upper plate containing a top and a bottom, a circular wall longitudinally extending from the bottom, multiple first reinforcement ribs being disposed on an inner side of the circular wall; two accommodation spaces being defined by the circular wall and those first reinforcement ribs, each accommodation being disposed with a groove, a socket being provided in each groove, multiple second reinforcement ribs being provided on the top and externally distributed in a radiation fashion with an outer side of the circular wall as a center;

two conduction portions with each comprised of a conduction reed and an elastic member and disposed in the accommodation space; and a lower plate provided with two sockets for the lower plate to be locked to the upper plate.

2. The lamp holder with improved structure as claimed in claim 1, wherein multiple assembly holes are disposed to the upper plate and multiple assembly grooves in a number same as that of those assembly holes are disposed on the lower plate; multiple wooden screws fasten the lower plate to the upper plate in a direction from the top of the upper plate down to the lower plate.

3. The lamp holder with improved structure as claimed in claim 1, wherein the conduction reed is comprised of a locking portion, a hooking portion, and a contact portion; the locking portion being held against by the elastic member and secured in the accommodation space; the hooking portion being relatively disposed in the groove to lock up a wire; and the contact portion being disposed in relation to the sockets for mounting an energy saving lamp.

4. The lamp holder with improved structure as claimed in claim 3, wherein a protruding section is disposed to the locking portion of the conduction reed at where abutted to the contact portion; the elastic member pushes against the protruding section to lock up the pins from the energy saving lamp; and the pins and the contact portion are connected to each other to constitute a conducted circuit.

5. The lamp holder with improved structure as claimed in claim 1, wherein each socket is related to a long socket for connecting the energy saving lamp; a retaining portion extends from the socket disposed in relation to the groove for covering up the groove; a post longitudinally extends from one side of the retaining portion; and the post and those first reinforcement ribs sandwich the conduction reed when the upper plate and the lower plate are jointed to each other.

6. The lamp holder with improved structure as claimed in claim 1, wherein multiple locking holes are disposed on the upper plate to mount the upper plate to a base disposed on the ceiling.

* * * * *